United States Patent [19]

Gatnarek

[11] Patent Number: 5,046,865

[45] Date of Patent: Sep. 10, 1991

[54] SIDE BEARING

[75] Inventor: Bruce Gatnarek, Glenshaw, Pa.

[73] Assignee: A. Stucki Company, Pittsburgh, Pa.

[21] Appl. No.: 405,416

[22] Filed: Sep. 11, 1989

Related U.S. Application Data

[63] Continuation of Ser. No. 110,531, Oct. 16, 1987, abandoned, which is a continuation of Ser. No. 944,654, Dec. 22, 1986, abandoned.

[51] Int. Cl.[5] ..... F16C 25/04

[52] U.S. Cl. ..... 384/423

[58] Field of Search ..... 384/599, 597, 423, 600, 384/601, 602; 105/199.3

[56] References Cited

U.S. PATENT DOCUMENTS

| | | | |
|---|---|---|---|
| 1,734,356 | 11/1929 | Welch | 384/597 |
| 2,301,372 | 10/1939 | Cottrell . | |
| 2,754,768 | 7/1956 | Hile | 105/197 |
| 3,518,948 | 7/1970 | King | 105/199 |
| 3,556,503 | 1/1971 | Van Moss, Jr. | 267/3 |
| 3,628,464 | 12/1971 | Van Moss, Jr. | 105/199 |
| 3,670,661 | 6/1972 | Pangalila | 105/199 |
| 3,796,167 | 3/1974 | Van Moss, Jr. | 105/199 |
| 3,957,318 | 5/1976 | Wiebe | 384/600 |
| 4,086,016 | 3/1978 | Wiebe . | |
| 4,090,750 | 5/1978 | Wiebe | 384/423 |
| 4,381,589 | 5/1983 | Cope | 384/423 |
| 4,567,833 | 2/1986 | Hanson | 105/199 |

OTHER PUBLICATIONS

U.S. patent application Ser. No. 851,350, filed 4-14-86.

*Primary Examiner*—Lenard A. Footland

*Attorney, Agent, or Firm*—Carothers & Carothers

[57] ABSTRACT

A side bearing for a railway car wherein spaced, elongated, resilient elastomeric elements bias a unitary friction generating element of the side bearing in operative position, the friction generating element being a separate member which is maintained in frictional engagement with a car body wear plate to provide improvements in the magnitude and uniformity of frictional energy dissipation and to provide, in cooperation with the elastomeric elements, improved bearing performance through the deformation of the elastomeric elements under initial loading and under operating load conditions.

24 Claims, 3 Drawing Sheets

SIDE BEARING

This is a continuation of co-pending application Ser. No. 07/110,531 filed on Oct. 16, 1987, abandoned, which is a continuation of Ser. No. 06/944,654, filed 12-22-86, abandoned.

This application is related to copending application Ser. No. 851,350, filed 4-14-86, assigned to the assignee of this application.

In a railway vehicle such as a freight car, a car body is supported on the center plates of a pair of spaced trucks having wheelsets with coned wheels. The geometry of the coned wheels, in cooperation with the railhead on which the wheels roll, imparts a steering influence to the wheelsets which cause them to travel a sinuous path along tangent or straight track as they continually seek a centered position on the track. In traveling such a sinuous path, a truck will yaw cyclically with respect to the car body about the vertical axis defined by the vertical center line of the truck bolster center plate. Of course, the truck will also yaw while rotating quasi-statically with respect to the car body in negotiating curved track. As a result of such cyclic yawing, the phenomenon known as hunting can occur if the truck yaw becomes unstable due to lateral resonance that can develop between the car body and the truck. The reader is referred to prior U.S. Pat. No. 3,957,318 for further explanation of railway vehicle hunting phenomena, as well as disclosure of a vehicle side bearing which utilizes resilient bearing elements to provide restraining friction and shear stiffness at magnitudes which have been successful for control of hunting responses. Such side bearings are in widespread use in modern railway rolling stock. The entire disclosure of prior U.S. Pat. No. 3,957,318 is incorporated herein and made a part hereof by reference.

Other prior side bearings have comprised spring or elastomer biased steel caps retained by a base or cage. Disclosures of railway car side bearings known to applicant include the following: U.S. Pat. Nos. 2,301,372; 2,754,768; 3,518,948; 3,556,503; 3,628,464; 3,670,661; 3,796,167; 4,090,750; 4,080,016; and 4,567,833. Included among these are disclosures of resilient side bearing elements. U.S. Pat. No. 4,567,833, in particular, discloses a side bearing with a resilient bearing element comprised of a rigid, unitary member which is completely encapsulated in a resilient elastomeric member. An uppermost surface of the elastomeric member is spaced vertically from the encapsulated rigid member and is maintained in frictional engagement with the car body wear plate.

The elastomeric side bearing disclosed in U.S. Pat. No. 3,957,318 has proven to be generally successful in controlling high speed, empty car hunting for many freight cars; however, higher speed performance of laterally sensitive, longer freight cars and intermodal freight cars with extremely light empty car bodies requires more rigid side bearing longitudinal restraint and higher magnitude of car body-to-side bearing interface friction for hunting control. For this purpose, the art has contemplated improved side bearings in which elastomer columns carry metallic, higher friction generating caps with each cap being biased be an elastomer column. Each elastomer column is so interlocked to its respective cap as to stiffen the longitudinal shear restraint of the side bearing, but at the same time retain the nearly linear elastic shear characteristic of longitudinal side bearing-to-car body motion which precludes impacting between metal parts. Such impact occurs in the case of other prior art metal cap side bearings that utilize vertical wall engagement between the side bearing top friction member or cap and the base member as a longitudinal shear restraint limit.

Some prior elastomeric side bearings exhibit a too soft linear shear restraint, or in the case of some rigid cap type side bearings, a soft or weak shear restraint between rigid limits. Also observed in some such prior side bearings is a tendency toward increased longitudinal clearance, due to wear, between the bearing cap and the base, and the necessity of lower maximum bearing preloads to insure that the maximum swivel resistance to side bearing restraint, for all the possible dynamic service conditions, will be less than the wheel-to-rail sliding friction under the empty car. Additionally, some such prior side bearings have been subject to extreme variation in preload magnitude and resulting high bearing friction level due to setup space variation.

Also in some prior side bearings, there is a tendency for nonuniform normal force distribution to arise between the wear plate friction surface and the mating bearing element surface. For example, the rotational moment (in a vertical plane) resulting from sliding friction between a wear plate and a bearing element tends to concentrate normal force toward one longitudinal end of the interface between the bearing element and the wear plate, thus creating a normal forced gradient over the length of the bearing element-to-wear plate engagement surface. Other factors also tend to promote such a normal force gradient. For example, the art has contemplated elastomeric, rigid capped side bearing elements where a uniformly sloping interface is provided between each elastomeric element and the respective rigid cap. This structure introduces a variation in the elastomer column height over the cross-section of the elastomeric element, and results in a corresponding variation in the percent of vertical compression of the elastomeric column, under preload and under varying operating loads, from the maximum height side to the minimum height side of the elastomer column. The variation in vertical compression results in a normal force gradient across the rigid cap-to-wear plate engagement surface in addition to the vertical force variation resulting from the horizontal shear induced moments.

The prior art has also contemplated an elastomeric column-to-rigid cap engagement structure which provides for initial compression of such an elastomeric column only adjacent the maximum column height side thereof with the initiation of vertical elastomer compression under increasing vertical loads proceeding toward the minimum column height side of the elastomeric element as the magnitude of the vertical load increases. The intended result is increased uniformity of vertical elastomer compression for the average bearing operating height or space, and consequent increased uniformity of wear plate-to-bearing element normal force distribution; however, this approach does not provide completely uniform normal force distribution at all normal force levels. Therefore, normal force gradients across the bearing element-to-wear plate interface are reduced but not eliminated.

Any such normal force gradients which do arise in known side bearing are accompanied by a rotational moment that either reinforces or partially cancels the rotational moment resulting from sliding friction as above described. This may result in undesirable cyclic patterns of rotational moment direction and magnitude that may increase non-uniform wear on the friction surface of both the side bearing cap and the car body wear plate.

In addition to the above, the limited wear plate engaging surface area of prior bearing elements tends to exaggerate the impact of normal force gradients because the gradient is spread across a limited expanse of area, and the gradient (i.e. the rate of normal force change) across a given dimension of the area is therefore greater than it would be if spread across a larger area. Nevertheless, the limitations of side bearing geometry and design, which permit accommodation thereof to conventional railway cars and bearing carriers, also have limited the maximum area and dimensions over which the bearing-to-wear plate normal force can be distributed.

BRIEF SUMMARY OF THE INVENTION

The present invention provides a side bearing which offers improved performance over the above characterized side bearings by means of a pair of longitudinally spaced, resilient elastomeric columns that are disposed in a conventional bearing carrier adjacent the respective longitudinal ends thereof. The elastomeric columns support a unitary, elongated, rigid cap which rests thereon and spans the space therebetween. The rigid cap extends longitudinally to overlie substantially the entire length of the bearing carrier and to present to the car body wear plate an elongated and enlarged friction interface surface area. This affords increased frictional dissipation of kinetic energy and reduced effect of any rotational moments imposed on the rigid cap in a longitudinally oriented vertical plane.

The unitary rigid cap also serves to internally carry nonuniform normal forces which would otherwise be transmitted to the car body wear plate. The structure of the invention also provides for the unitary rigid cap having generally opposite and equal rotary moments imposed thereon by such nonuniform normal force distributions resulting from engagement with the elastomeric columns. Since the rigid cap does not transmit the rotational moments or nonuniform force distributions to the car body wear plate, the incidence of normal force gradients across the cap-to-wear plate friction interface is significantly reduced. By this and other structural improvements, the invention affords enhanced uniformity of bearing frictional response and mechanical wear.

The invention also retains the shear flexibility of prior art all-elastomer side bearings in both shear and compression stiffness while the rigid cap provides additional necessary friction for higher speed hunting control. The invention also provides for bearing fitup with no longitudinal free space and with little or no anticipated wear due to elastomer-metal vertical interfaces as well as continuous longitudinal wear compensation at locations where wear between metal-to-metal interfaces is prone to occur, thus insuring longer bearing life with effictive truck hunting control at higher speeds. The result is greater lateral stability for higher freight car speeds, i.e. higher threshold hunting speeds for freight cars with coned wheel trucks, and improved service life of the side bearings as well as the side bearing attachments or fasteners.

In this invention a metal friction cap, with proper longitudinal biasing geometry, interlocks with a pair of elastomer columns that abut the respective longitudinal ends of the side bearing carrier or cage. The rigid metal cap also ensures consistent sliding friction performance by conducting most of the friction-generated heat from the sliding interface, thereby maintaining greater uniformity of elastomer temperature, and more consistent elastomer shear and compression stiffness. In a presently preferred embodiment of the invention, a maximum elastomer column height is also utilized to achieve more uniform metal friction cap biasing and a resultant narrower range of truck restraining friction for the required range of set-up space and operating variations.

Also contemplated is an inclined or sloping elastomer-to-metal cap interface geometry and an embodiment wherein the longitudinal elastomer abutment engages and interlocks with vertically extending surfaces of the adjacent elastomeric column for lateral side bearing rigidity to provide a component of lateral car body-to-bolster restraint which is additive in its effect to the longitudinal side bearing restraint for even higher speed lateral stability.

It is therefore one object of the invention to provide a railway car side bearing with improved uniformity of bearing element-to-wear plate normal force distribution.

Another object of the invention is to provide a side bearing wherein vertical loading discontinuities imposed by the elastomeric bearing elements are transmitted to a unitary, rigid cap member that is supported by the elastomeric bearing elements to provide a friction interface with the car body wear plate, and which cap member bears such load discontinuities internally and does not transmit them in turn to the car body wear plate.

A more specific object of the invention is to provide a railway car side bearing having a pair of longitudinally spaced apart elastomeric columns disposed adjacent the respective longitudinal ends of a conventional bearing carrier, and a unitary rigid cap member which is supported by the elastomeric columns and bridges the space therebetween to provide an enlarged, unitary friction interface between the side bearing and the car body wear plate. With this, and the particular mode of engagement between the elastomeric columns in the unitary cap, there is provided improved uniformity of normal force distribution and reduced rotational moments at the rigid cap-to-wear plate friction interface.

Another object of the invention is to provide a side bearing wherein the wear surface of a rigid wear cap element that, at the limits of relative motion, with respect to the car body wear plate, may project further beyond the longitudinal and lateral extent of the car body wear plate than has been heretofore possible, without incurring either loss of performance or damage. This permits the use of a shorter and narrower car body wear plate.

These and other objects and further advantages of the invention are more fully described in the following detailed description, with reference to the accompanying drawings, in which.

Figure 1:
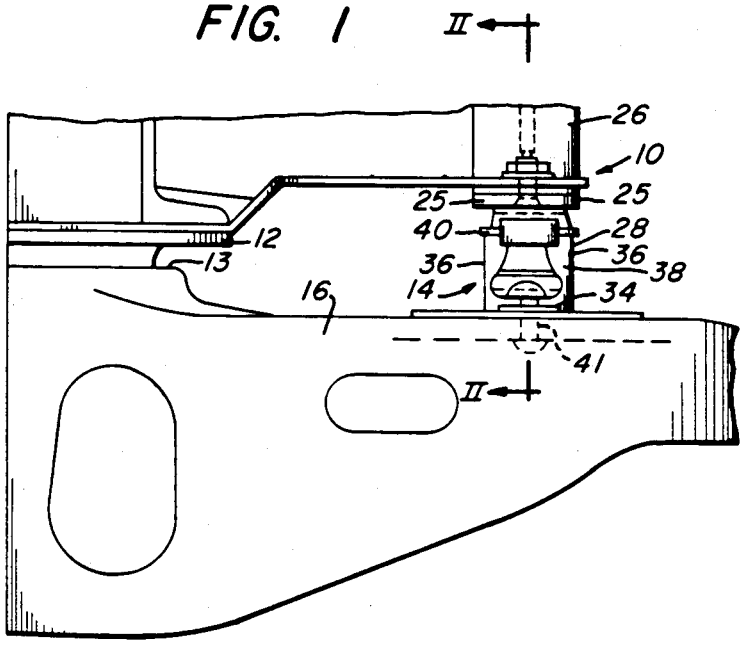
FIG. 1 is a fragmentary, generally schematic elevation of portions of a railway vehicle truck and a car body supported thereby with a side bearing of the present invention mounted therebetween.

In FIG. 1 there is generally illustrated at 10 a fragmentary portion of a four-wheel railway freight car body and truck assembly in which a car body center plate 12 is supported on a centerplate portion 13 of a bolster 16 to support the car body 26 as is well known. Well known spring groups (not shown) are located in a pair of side frames (not shown) to support the bolster 16, and suitably journaled wheel sets (not shown) rest on rails (not shown) to support each side frame with respect to the rails in the well known manner. Wear plates 25 are carried by car body 26 for engagement with each of a pair of side bearing assemblies 14 (only one shown). Inasmuch as the invention herein is primarily directed to side bearing assemblies 14 and the balance of the elements set forth hereinabove are well known in the art, further detailed description of such known elements is believed unnecessary for an understanding of the present invention.

Figure 2:
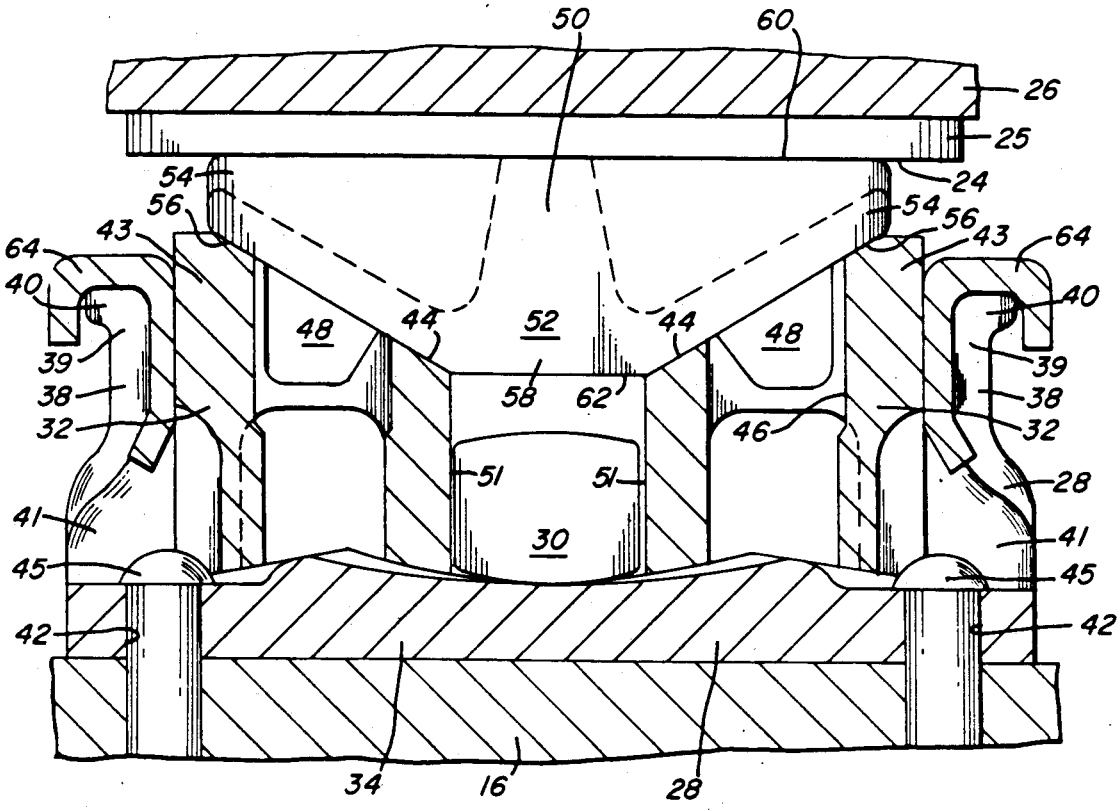
FIG. 2 is a sectional side elevation taken on line II—II of FIG. 1.

Referring to FIG. 2, side bearing 14 comprises: a conventional elongated bearing carrier or channel 28; a formed steel rocker 30 disposed within channel 28; a pair of spaced elastomeric bearing blocks or members 32, each of which is disposed in channel 28 intermediate rocker 30 and a respective axial end of channel 28; and a rigid, preferably metallic, unitary bearing cap member 50 disposed atop members 32. Bearing channel 28 includes a longitudinally extending base 34 and a pair of transversely spaced side walls 36 (FIG. 1) which project upwardly from and extend along the opposite sides of base portion 34. Respective longitudinal end portions 38 of side walls 36 turn inwardly toward the longitudinal center line of channel 28. As shown, each end portion 38 includes an upper, generally vertical section 39 and a lower section 41 which extends downwardly and flares outwardly from vertical section 39. A peripheral flange 40 projects outwardly from each sidewall 36 and end portions 38 adjacent the uppermost extent thereof.

In assembly, the longitudinal extent of channel 28 is disposed transversely of the longitudinal extent of bolster 16 so as to extend longitudinally of the car body. Channel 28 is affixed to bolster 16 in any suitable manner, for example, by well known rivets 45 or the like which extend through longitudinally spaced bores 42 in base portion 34.

Each elastomeric bearing block 32 is formed from resiliently deformable elastomeric material to have a configuration suitable to accommodate insertion of one of blocks 32 into channel 28 on either side of rocker 30 intermediate the rocker 30 and the respective adjacent end of channel 28. The particular form of each block 32 is subject to modification within a latitude of design criteria; however, in general blocks 32 may be similar in many respects to the corresponding elastomeric bearing members described in above-cited U.S. Pat. No. 3,957,318. More particularly, if desired each block 32 may include a relatively "hard" upper portion and a relatively "soft" lower portion having different elastic moduli as more fully shown and described in the referenced U.S. Pat. No. 3,957,318. Furthermore, this combination of relatively hard and soft elastomers in a single bearing element may be applied to any contemplated embodiment of the invention described herein, although bearing elements formed from a single elastomeric material of uniform elastic modulus may also be suitable.

The upper end portion 43 of each elastomeric member 32 forms a sloping contact or engagement surface 44 and an upwardly open formed recess 46 which is defined within the confines of the cross section of upper end portion 43 and extends downwardly therein within the generally hollow interior of each member 32.

The surfaces 44 of members 32 slope upwardly from rocker 30 toward the respective opposite ends of side bearing assembly 14 to form therebetween a pocket which receives the cap 50. Cap 50 comprises a rigid, metallic unitary body 52 having spaced end portions 54 with sloping undersurfaces 56 that are oriented for complementary engagement with surfaces 44 of the respective members 32 to support cap 50 with respect to the members 32. One of a pair of projections 48 extends downwardly from each surface 56 of cap 50 to be received in the recess 46 of the respective member 32, as described. An intermediate portion 58 of body 52 extends intermediate the end portions 54 of cap 50 to bridge the space between members 32 and thereby generally overlie rocker 30. Projections 48 are dimensioned for a lateral interference fit within recesses 46 to provide an interlocking means for positive retention of cap 50 in the described installed configuration atop members 32. The engagement of projections 48 in respective recesses 46 also provides a heat conducting path from the highest temperature locations developed in operation within members 32 to wear plate 25 via cap surface 60 for improved dissipation of heat from members 32. As shown, the projections 48 are generally fin-shaped, and are provided with clearance from the longitudinal ends of recesses 46 whereby the cap 50 is longitudinally movable with respect to members 32.

To assemble the side bearing 14, a pair of the blocks 32 are disposed within channel 28 adjacent the respective ends thereof and end closures 64 are inserted intermediate the respective longitudinally outer surfaces of blocks 32 and the inturned end portions 38 of sidewalls 36. Closures 64 thus retain blocks 32 and prevent the elastomer from extruding between end portions 38 of sidewalls 36. Rocker 30 is then inserted between the blocks 32 and cap 50 is installed atop blocks 32 as described.

An upper surface 60 of cap 50 extends generally horizontally when cap 50 is installed as described on blocks 32 so as to provide a friction surface for engagement by the wear surface 24 of wear plate 25. The enlarged expanse of surface 60 provides an enlarged area of frictional engagement with wear plate surface 24 over the frictional engagement area afforded by conventional elastomeric side bearings.

Cap 50 is also provided with a generally horizontally extending intermediate undersurface 62 which merges with sloping undersurfaces 56 and extends therebetween above rocker 30. Under vertical load, cap 50 is vertically displaceable by vertical compressive deformation of blocks 32 to the limit defined by engagement of surface 62 with rocker 30, when rocker 30 is supported on base 34. It is noted that under no-load conditions, the available range of vertical movement for cap 50 is less than the vertical dimension from surface 60 thereof to the uppermost extent of carrier 28 (e.g. in the FIG. 2 embodiment, the uppermost extent of end closures 64 which rest atop the inturned ends 38 of sidewalls 36). This maximum available vertical movement of cap 50 defines the limit of vertical compressive deformation which may be imposed upon members 32.

As has been noted, the bearing channel 28 is generally of a conventional configuration and similar to those used on the vast majority of railway freight car side bearings in use today. Because it is one object of the present invention to provide means to retrofit existing side bearings to obtain advantages of the present invention, it will be understood that modification to the embodiments of the bearing members described herein can be readily made for accommodation to alternative bearing channel configurations to achieve totally new configurations of side bearing assemblies. Furthermore, it is anticipated that given knowledge of the present invention, various modifications can be made to the embodiments described either in retrofit or in new side bearing configurations without departing from the spirit or scope of the invention.

FIG. 2 shows the side bearing 14 in the unloaded state. In practice, each side bearing 14 is preloaded in compression by the car body weight. Metallic cap-to-wear plate frictional engagement is maintained throughout a range of normal or vertical loads to provide frictional response suitable for control of hunting and other dynamic responses. The desired range of normal loads preferably corresponds to a range of commonly experienced relative roll positions that the car body normally assumes with respect to the truck bolster in travel. Thus, upon assembly of a car body 26 on trucks equipped with side bearings 14, the wear plate surfaces 24 will frictionally engage the uppermost surfaces 60 of the respective metallic caps 50 and, under the weight of the car body 26, each respective pair of elastomeric members 32 will be deformed in vertical compression until the car body center plate 12 rests on the truck center plate 13. The vertical compressive deformation results in sufficient transverse expansion of the elastomer to insure longitudinal confinement of the elastomeric members 32 between the bearing components and the carrier in which they reside. This permits the invention to accommodate variation in the length of various bearing carriers resulting from manufacturing tolerances and component wear in service. When the car body 26 is supported at rest on center plate 13, elastomeric members 32 are preloaded in vertical compression to a predeterminable extent less than the compression required to bring the surfaces 62 into engagement with rockers 30. A further predeterminable increment of vertical compression of members 32 is therefore available to accommodate and control car body roll.

At preload vertical compression of members 32, or at maximum vertical compression, or at any degree of compressive deformation between these limits, the members 32 will be subject to horizontal shear deformation in response to relative movements, including relative yaw, or car body 26 with respect to bolster 16. The side bearing 14 accommodates such relative movement with initial horizontal shear deformation. Thus, in response to such horizontal movements, the upper portion 43 of each member 32 deforms in shear to accommodate the movement until the frictionally engaged surfaces 60 and 24 break static friction and slide frictionally upon one another. The shear deformation of the upper end 43 of each member 32 thus accommodates an initial increment of relative motion, and the frictional sliding of cap 50 on wear plate 25 accommodates further increments of relative motion.

It will be appreciated that the available shear deformation of members 32 permits the static frictional engagement between the cap 50 and wear plate 25 for each bearing assembly 14 to be maintained throughout the normal operation of the freight car on straight or very slightly curved track. The invention thereby effectively controls hunting within acceptable limits primarily by such frictional engagement. In other words, side bearings 14 control hunting by providing longitudinal shear constraint within a predetermined acceptable range of shear forces to assure that the linear shear restraint is sufficiently stiff to inhibit the onset or initiation of any change in either the wheelset yaw orientation or the lateral position thereof between the rails. The maximum shear force that the bearing interface will tolerate without sliding is limited by the friction developed between cap 50 and wear plate 25, and the shear force limit is therefore variable with variation of the vertical compression of the elastomeric members 32. In any event, the shear force developed is to be sufficient to inhibit hunting throughout the range of elastomer compression caused by car body roll, but must also be sufficiently limited to allow friction break and relative sliding between wear plate 25 and cap 50 for proper wheel set steering or tracking.

It is desirable, of course, that members 32 exhibit mechanical properties (such as modulus of elasticity) that will permit side bearing performance with the requisite stiffness in shear to prevent hunting while maintaining the ability to deform in vertical compression for dynamic and preload conditions. For example, the members 32 may have a modulus of elasticity in the range of 7,000 to 20,000 psi. Some elastomers with a modulus of elasticity falling outside of the indicated range may, in conjunction with suitable design modifications, also permit acceptable side bearing performance, but applicant is less certain of the suitability of such elastomers. The indicated range for modulus of elasticity therefore is intended as disclosure of the best presently contemplated mode of the invention, and not as a limitation on the invention, except insofar as such a limitation may be expressly recited in the claims appended hereto. Of course, the modulus of elasticity and hardness of the respective portions of member 32 having relatively "hard" and "soft" portions, as above described, are selected to provide performance consistent with the specified ranges for these parameters. A more extensive discussion of the desired mechanical properties for the elastomeric members utilized in conjunction with this invention will be found in the above referenced U.S. Pat. No. 3,957,318. Additionally, it should be noted that most elastomeric materials, including urathanes, relax or exhibit initial creep under load. Accordingly, the mechanical properties discussed above are those observed after initial loading and a suitable relaxation period at room temperature.

The hollow interior space of each elastomeric block 32 accommodates the lateral expansion of the elastomer which results as one mode of deformation occurring during vertical compression of the members 32 under load. This affords an elastomeric bearing block which is not as stiff as a solid block of the same material would be. As further accommodation for horizontal expansion of members 32 under vertical load, transverse clearance may be provided as at 51 to accommodate longituidnal expansion, and entirely similar lateral or side gaps (not shown) may be provided to accommodate laterally outward expansion or deformation of members 32 under vertical load.

Due to the sloping or inclined engagement interface between members 32 and cap 50, the preload of a car body on the side bearing not only compresses the members 32 vertically, it also provides a wedging action that urges elastomeric members 32 longitudinally outward toward the respective ends of channel member 28. Thus, the bearing assemblies take up all free space or slack between the ends of channel 28. Further, this structural aspect of the invention offers improved uniformity of shear response of the elastomer and provides a self-centering action which tends to center the cap 50. The described wedging action permits control to be achieved with the minimum force. This is of considerable benefit for light cars where the magnitude of the vertical preload force is relatively small.

Figure 3:
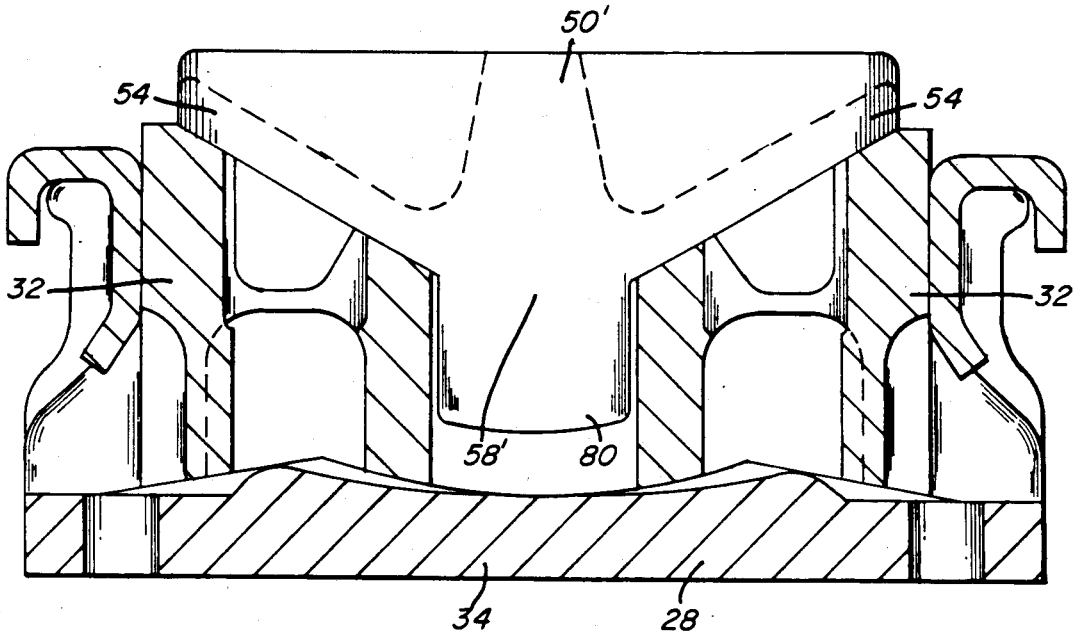
FIG. 3 is a sectional side elevation of an alternative embodiment of the invention.

In FIG. 3, an alternative embodiment of the invention comprises a rigid bearing element 50' which is similar in many respects to the element 50 of FIG. 1, but which includes in addition an intermediate portion 58' between end portions 54 and having a depending portion 80 that projects downwardly intermediate the elastomeric members 32 to engage the base portion 34 of carrier 28 upon sufficient vertical compressive deformation of the elastomeric members 32. The portion 80 thus is provided in lieu of rocker element 30 of the FIG. 2 embodiment to limit vertical compressive deformation of members 32. Also for this embodiment, the center of rotation for any longitudinal rocking motion of the bearing cap 50' is located further downward than for the embodiment that provides a separate rocker element as shown in FIG. 2. Thus, for the FIG. 3 embodiment, a given magnitude of rotational moment, in a longitudinally oriented vertical plane, will result in a smaller angle of rotary motion of the rigid cap. This further enhances the ability of the invention to offset or negate rotary moments applied to the bearing wear member.

Figure 4:
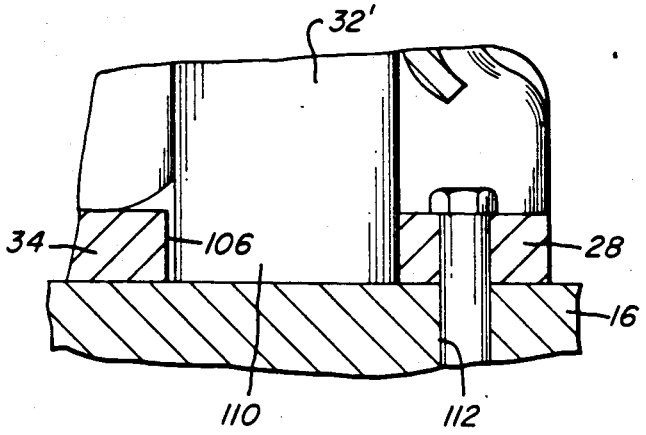
FIG. 4 is a fragmentary, sectioned side elevation showing a modification of the invention.

FIG. 4 shows a modification of the invention wherein base 34 of carrier 28 includes an aperture 106 that receives the lower end 110 of elastomeric member 32', which of course is therefore of greater vertical height than the above described elastomeric members 32. The elongated member 32' and cooperating aperture 106 serve to provide an elastomer column of greater height than is available otherwise. The resulting increase in elastomer column vertical height proportionately reduces the percentage compressive deformation of the elastomeric column for any given increment of downward movement of cap 50 under vertical loading. Accordingly, at the nominal set-up space operation height enhanced uniformity of normal force distribution across the wear plate-to-rigid cap interface is achieved. That is, the magnitude of the normal force variation from nil to maximum normal force is less for taller elastomeric members 32' than for shorter members 32 of the same material and operating under the same conditions. The same applies, of course, for the range of normal force resulting from the preload exerted by the empty car body weight supported on the side bearings and the center plate.

Figure 5:
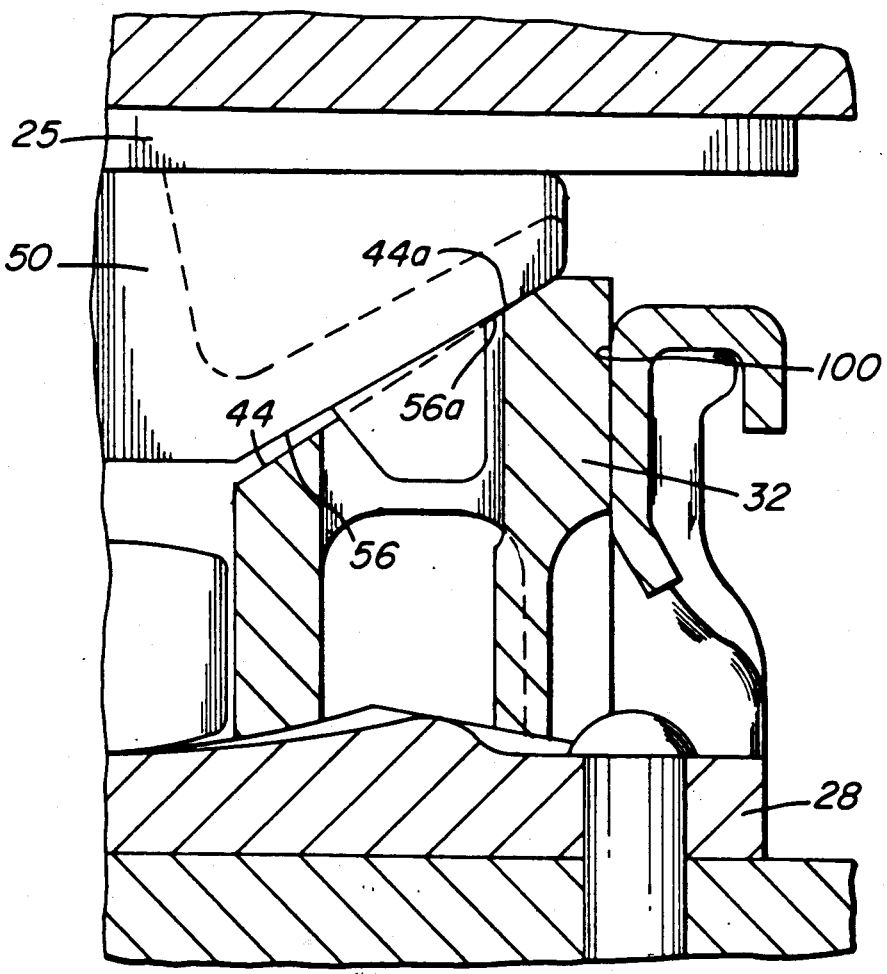
FIG. 5 is a fragmentary, sectioned side elevation showing a further modification of the invention.

FIG. 5 shows a further refinement of the invention which produces additional uniformity of wear plate-to-side bearing cap normal force. Specifically, there is shown a portion of a side bearing similar to that shown in FIG. 2 but incorporating in addition an intentionally mismatched angle between the mating surfaces of cap 50 and the elastomeric member 32. When cap 50 is engaged with wear plate 25 and at rest, the sloping lower surface 56 of cap 50 extends at a shallower angle with respect to horizontal and the mating surface 44 of elastomeric member 32. The magnitude of difference between the slope angles of the mating surfaces is exaggerated in FIG. 5 for clear illustration. With this structural refinement, only the upper end portions **56*a* and 44*a* of the two mating surfaces 56 and 44 are engaged under free standing, no-load rest conditions. As noted hereinabove, vertical compressive loading ordinarily would tend to produce nonuniform vertical compression and therefore non-uniform normal force at the friction interface, because the vertical column height of the elastomeric members varies across the elastomeric cross-section, decreasing from a maximum adjacent the ends of the carrier 28 to a minimum adjacent rocker 30. In order to compensate for this variation in column height, it is desirable to provide the mismatched angle of FIG. 5 so that, at the onset of the vertical compressive deformation, the taller side of the elastomeric member 32** will be compressed initially with the initiation of compressive deformation progressign down the sloped interface to the shorter side of the elastomeric column as loading increases incrementally. The result is more uniform vertical compressive deformation, ideally approaching that of a horizontal or non-sloping cap-to-elastomer interface. The mismatched angle, in combination with other structural features of the invention as above described, thus helps to maintain the elastomer strain within desired limits of magnitude and uniformity to provide optimal side bearing performance.

The mismatched angle structure also provides more efficient initial load transfer to the end abutment 100 which defines the longitudinally outermost position of elastomeric elements 32. That is, with the elastomeric element wedged outwardly against abutment 100, the mismatched angle serves to concentrate initial outward wedging force near the top of the elastomeric column so that a thinner section of elastomer is being compressively deformed between the cap 50 and abutment 100 under initial loading. The force transfer therebetween is therefore more direct. A desirable increase in the longitudinal shear stiffness of the side bearing is also achieved thereby. The unitary cap 50 also serves to provide solid reaction structure to support the longitudinally outwardly directed wedging forces since the preload wedging forces imposed on the elastomeric elements 32 generally will be equal and opposite forces.

From the description hereinabove, it will be seen that the invention provides a novel and improved railway vehicle truck side bearing which affords more uniform normal force distribution over an enlarged interface area at the frictional interface between the side bearing and the car body wear plate. The invention contemplates multiple modes of improved normal force uniformity including, most notably, reduced variation in the magnitude of total normal force in operation and reduced normal force gradients across the side bearing friction interface at any attainable normal force level. Both of these improvements in normal force uniformity contribute to more uniform side bearing-to-wear plate friction, and resultant improvements in both bearing wear characteristics and in frictional dissipation of energy for hunting control.

Various benefits of the invention as described and as afforded by the structural particulars of the described embodiments may well be attainable in various modified or alternative embodiments of the invention which would readily occur to those versed in the art, once apprised of my invention. Accordingly, it is my intent that the invention be construed broadly in accordance with the scope and breadth of the claims appended hereto.

I claim:

1. A side bearing assembly for a railway freight car comprising: a rigid channel member having upstanding side and end portions which define an upwardly open cavity therebetween;

elastomeric elements located within said cavity inwardly adjacent said end portions, respectively, to define a space therebetween within said channel member;

said elastomeric elements including upper end portions which extend upwardly above the uppermost portions of said side and end portions;

a rigid unitary member extending between and supported by said upper end portions of said elastomeric elements;

said rigid unitary member having an upper surface adapted to frictionally engage the wear surface of a side bearing wear plate such as is carried by a freight car body;

and at least said upper end portions of said elastomeric elements being deformable within a range of applied compressive forces, such as are applied to said elastomeric elements when said upper surface is in frictional engagement with such a wear surface, to permit relative movement between said rigid unitary member and said channel member throughout said range of applied compressive forces.

2. The side bearing assembly as set forth in claim 1 wherein said upper end portions include respective sloping engagement surfaces which are engageable with corresponding surfaces of said rigid unitary member, said sloping engagement surfaces converging downwardly toward said space.

3. The side bearing assembly as set forth in claim 1 wherein an area of engagement between said sloping engagement surfaces and said corresponding surfaces is variable with varying magnitudes of loading within said range of applied compressive forces.

4. The side bearing assembly as set forth in claim 3 wherein said area of engagement is a minimum area for a minimum applied compressive force within said range, and a maximum for a given magnitude of applied compressive force greater than said minimum applied force.

5. The side bearing assembly as set forth in claim 4 wherein said minimum area is located adjacent uppermost end portions of said sloping surfaces, respectively.

6. The side bearing assembly as set forth in claim 5 wherein said area of engagement increases from said minimum area under increasing magnitudes of force within said range of applied compressive forces by increments progressing down the slop of said sloping engagement surfaces from said uppermost end portions thereof.

7. The side bearing assembly as set forth in claim 6 wherein said applied of compressive force on said sloping engagement surfaces is distributed substantially uniformly over said area of engagement between said sloping engagement surfaces and said rigid unitary member.

8. The side bearing assembly as set forth in claim 1 wherein said upper end portions include respective engagement surfaces and said rigid unitary member includes corresponding surfaces which are maintained in complementary engagement with said engagement surfaces, respectively, substantially throughout the extent of said engagement surfaces at substantially all magnitudes of applied compressive force within said range.

9. The side bearing assembly as set forth in claim 8 wherein said engagement surfaces are sloping engagement surfaces which converge downwardly toward said space.

10. The side bearing assembly as set forth in claim 1 wherein said upper end portions include respective engagement surfaces and said rigid unitary member includes corresponding surfaces which are maintained in engagement with said engagement surfaces in a non-complementary manner wherein the area of engagement therebetween is variable with varying magnitudes of said applied compressive forces within said range.

11. The side bearing assembly as set forth in claim 10 wherein said engagement surfaces are sloping engagement surfaces which converge downwardly toward said space.

12. The side bearing assembly as set forth in claim 1 wherein said upper end portions of said elastomeric elements extend upwardly above said uppermost portions of said side and end portions in all operating positions of said elastomeric elements.

13. The side bearing assembly as set forth in claim 1 wherein said rigid unitary member is supported by said upper end portions of said elastomeric elements in a manner that the applied compressive forces simultaneously bias said elastomeric elements.

14. A side bearing assembly for a railway freight car comprising:

a rigid channel member having upstanding side and end portions which define an upwardly open cavity therebetween;

elastomeric elements located within said cavity inwardly adjacent said end portions, respectively, to define a space therebetween within a said channel member;

said elastomeric elements including upper end portions;

a rigid unitary member extending between and supported by said upper end portions of said elastomeric elements;

said ridig unitary member having an upper surface adapted to frictionally engage the wear surface of a side bearing wear plate such as is carried by a freight car body;

and at least said upper end portions of said elastomeric elements being deformable within a range of applied compressive forces, such as are applied to said elastomeric elements when said upper surface is in frictional engagement with such a wear surface, to permit relative movement between said rigid unitary member and said channel member throughout said range of applied compressive forces.

15. The side bearing assembly as set forth in claim 14 wherein said upper end portions include respective engagement surfaces and said rigid unitary member includes corresponding surfaces which are maintained in complementary engagement with said engagement surfaces, respectively, substantially throughout the extent of said engagement surfaces at substantially all magnitudes of applied compressive forces within said range.

16. The side bearing assembly as set forth in claim 15 wherein said engagement surfaces are sloping engagement surfaces which converge downwardly toward said space.

17. The side bearing assembly as set forth in claim 14 wherein said upper end portions include respective engagement surfaces and said rigid unitary member includes corresponding surfaces which are maintained in engagement with said engagement surfaces in a non-complementary manner wherein the area of engagement therebetween is variable with varying magnitudes of said applied compressive forces within said range.

18. The side bearing assembly as set forth in claim 17 wherein said engagement surfaces are sloping engagement surfaces which converge downwardly toward said space.

19. In a side bearing assembly for a railway freight car wherein a rigid channel member having upstanding side and end portions defines an upwardly open cavity which is adapted to retain an assembly of bearing elements, said assembly of bearing elements comprising:

elastomeric elements adapted to be located within such a cavity inwardly adjacent such end portions, respectively, to define a space therebetween within such a channel member;

said elastomeric elements including upper end portions which are adapted to extend upwardly above the uppermost portions of such side and end portions;

a rigid unitary member extending between and supported by said upper end portions of said elastomeric elements;

said rigid unitary member having an upper surface adapted to frictionally engage the wear surface of a side bearing wear plate such as is carried by a freight car body;

and at least said upper end portions of said elastomeric elements being deformable within a range of applied compressive forces, such as are applied to said elastomeric elements when said upper surface is in frictional engagement with such a wear surface, to permit relative movement between said rigid unitary member and such a channel member throughout said range of applied compressive forces.

20. The assembly of bearing elements as set forth in claim 19 wherein said elastomeric elements and said rigid unitary member include mutually cooperable interlocking means for interlocked support of said rigid unitary member by said elastomeric elements.

21. A railway vehicle side bearing comprising:

an elongated bearing carrier which includes upstanding spaced apart side walls and end walls which encompass an upwardly open cavity;

a pair of elastomeric elements disposed at longitudinally spaced locations within said cavity adjacent the end walls thereof, respectively;

each said elastomeric element having an upper end portion;

a unitary, rigid friction element extending between and supported by said end portions, respectively;

said friction element including an upper surface located for bearing engagement by a car body wear plate during relative longitudinal and lateral movement of such a side bearing with respect to such a wear plate;

and said elastomeric elements and said friction element including mutually cooperable sloped engagement surface means which converge downwardly and have respective surface portions that are mutually engageable in biased engagement to provide support of said friction element by said elastomeric elements throughout the duration of such bearing engagement, the area of engagement between the respective said surface portions being variable in a manner that the force of said biased engagement is distributed substantially uniformly over said area of engagement throughout a range of magnitudes of said biased engagement.

22. The side bearing as set forth in claim 21 wherein said area of engagement is variable in response to variation in the magnitude of said biased engagement.

23. In a railway vehicle side bearing having a rigid elongated channel member which is adapted to be affixed to the bolster of a railway vehicle truck to extend in a generally horizontal orientation with upwardly projecting side walls and longitudinally spaced end walls of the channel member having respective uppermost edges to define an upwardly open elongated cavity that is adapted to retain a bearing assembly therein for engagement with a wear plate carried by a railway car body, said bearing assembly comprising:

elastomeric bearing means adapted to be captively received in an upstanding orientation within such a cavity and including at least a pair of elastomeric elements located adjacent the respective end walls of the cavity to define a space longitudinally therebetween within such a cavity;

said elastomeric elements having respective upper end portions;

a rigid unitary friction means extending between said upper end portions and spanning said space therebetween, and including a bearing surface portion adapted for frictional engagement with such a wear plate;

said friction means and the respective upper end portions including interengageable portions which are mutually cooperable to support said friction means with respect to the channel member in a manner that a portion of each of said elastomeric elements, when deformed by essentially vertical compressive loading upon vertical movement of said friction means with respect to the channel member, is positioned with respect to the respective adjacent end wall such that, upon application to said elastomeric elements of loads directed horizontally of such a channel at least one of the respective said elastomeric elements deforms in horizontal shear; and means adapted to cooperate with such a channel member for limiting vertical movement of said friction means in the direction which produces such essentially vertical compressive loading.

24. A side bearing adapted to be mounted on an upwardly facing surface of a railway truck bolster comprising, when so mounted:

an elongated member having a lowermost base portion and upwardly extending side wall portions and end wall portions which define an upwardly open elongated cavity;

said wall portions having uppermost edges throughout their extent;

upstanding elastomeric elements disposed within said cavity adjacent said end wall portions, respectively, to define a space longitudinally therebetween;

said elastomeric elements having uppermost end surfaces which extend at an acute angle with respect to a generally horizontal plane;

a rigid, unitary means supported by said elastomeric elements to extend upwardly therefrom;

said rigid, unitary means having spaced apart portions with lower surfaces which are engageable with said uppermost end surfaces of said elastomeric elements, respectively, and an intermediate portion extending between said spaced apart portions; and rigid bearing means located within said cavity between said elastomeric elements and cooperable with said rigid unitary means and said base portion to limit the magnitude of vertical downward movement of said rigid unitary means which occurs upon vertical compressive deformation of said elastomeric elements.

* * * * *